United States Patent [19]

Farrell et al.

[11] Patent Number: 4,770,342

[45] Date of Patent: Sep. 13, 1988

[54] ADJUSTABLE RAIL BRACE

[75] Inventors: A. W. Farrell, Naperville; Frederick S. Mitchell, Carol Stream; James A. Remington, Richton Park, all of Ill.

[73] Assignee: ABC Rail Corporation, Chicago, Ill.

[21] Appl. No.: 11,120

[22] Filed: Feb. 5, 1987

[51] Int. Cl.[4] ..... E01B 9/60; E01B 9/48

[52] U.S. Cl. ..... 238/347; 238/292; 238/336; 238/361

[58] Field of Search ..... 238/336, 333, 331, 347, 238/349, 351, 359, 292, 310, 282, 337, 361

[56] References Cited

U.S. PATENT DOCUMENTS

| | | | |
|---|---|---|---|
| 2,515,678 | 7/1950 | Vickroy | 238/292 |
| 4,566,630 | 1/1986 | Keiper, Jr. | 238/347 |
| 4,625,912 | 12/1986 | Fee | 238/349 |

*Primary Examiner*—Robert B. Reeves
*Assistant Examiner*—Joseph D. Pape
*Attorney, Agent, or Firm*—Thomas S. Baker, Jr.

[57] ABSTRACT

An adjustable rail brace assembly for buttressing the head of a rail includes a rail brace having surfaces for engaging the head and the base of the rail and a vertically extending wedging face, a cover plate for retaining the brace having a vertical wedging face which compliments the brace wedging face, and an interlock for interlocking the brace wedging face and the cover plate wedging face such that the brace and the cover plate can move relative to each other in a vertical plane, but are restrained from moving relative to each other in a horizontal plane, and an elastic fastener for engaging the cover plate to prevent vertical movement of the cover plate.

17 Claims, 2 Drawing Sheets

ADJUSTABLE RAIL BRACE

BACKGROUND OF THE INVENTION

Rail braces are utilized to buttress railroad switch stock rails against the side thrusts of the rail traffic tending to overturn them. When a rail is overturned, the head of the rail is rotated about the origin of the rail to a position in which it is angularly offset with respect to a vertical line through the vertical axis of the rail. The head of the rail rotates with respect to the base of the rail because the base is anchored or fixed in the rail ties whereas the head of the rail which supports the traffic load is free to move. Rotation of the rail head is undesirable because if a lateral load is applied to the head of a rail over a relatively long length of rail, it is possible that the lateral load may cause the entire rail to roll over.

A rail brace supports a stock rail by being restrained against movement towards the rail and by having an upper surface which bears against a fishing surface formed on the underside of the head of the rail and a lower surface which bears against a fishing surface formed on the top side of the base of the rail. Traditionally, some braces have been anchored by being spiked to a wooden tie. However, rail braces eventually loosen and it is necessary to periodically tighten the brace so that it firmly engages the base and head of the rail. When a brace is spiked to a tie, it is necessary to remove the spikes and redrive them. Eventually the tie must be replaced because it has an excessive number of spike holes.

Because of the disadvantages inherent in fixed rail braces, adjustable braces were developed which eliminated the need to respike the brace assembly each time the brace was tightened. In one type of adjustable brace, one side of the base of the brace is set at an angle and this side directly engages a stop on the tie plate set at a similar angle to thereby provide a wedging action of the brace between the rail and the stop. In another type of adjustable brace, a wedge is interposed between the brace and a stop secured to the tie plate. After the wedge or brace is driven into position, the adjustable brace may be secured by bolts, nuts or by lag screws. In some instances, the wedge member has been secured by having a cover plate that is secured by bolts to the tie plate to engage the wedge member or the wedge member and the brace to thereby secure these elements.

Because it is has been found inconvenient to utilize bolts or lag screws to secure rail braces, the railroad industry recently has begun to utilize elastic fasteners such as spring clips to bias adjustable rail braces against stock rails. In one type of adjustable brace utilizing a spring clip, the base of the brace is set at an angle with respect to the surfaces on the brace which engage the rail and the angled base engages a stop mounted on the tie plate set at a similar angle to thereby provide a wedging action for urging the brace against the rail. The elastic fastener biases a cover plate downwardly against a flat surface formed on the top of the brace to prevent vertical and horizontal movement of the brace. The surface on the brace may be corrugated and engage a similarly corrugated surface formed on the bottom of the cover plate to further inhibit logitudinal movement of the brace. The axis of the elastic fastener is non-parallel to the surfaces of the rail brace which engage the stock rail. One problem with having the axis of the fastener non parallel to that of the rail is that automatic equipment utilized to install such fasteners can only install these fasteners if the axes of the fasteners is parallel to that of the rail. If the axes are not parallel to the rail, the fasteners must be installed manually.

It has been found that where an elastic fastener has been utilized to clamp or lock a cover plate against a horizontal surface on a rail brace, vibration and movement of the rail may cause the rail brace to loosen. This occurs because as the traffic passes over the rail, the rail and the brace move vertically downwardly and momentarily may be out of contact with the cover plate. As a result, the top surface of the brace tends to separate from the cover plate and the brace and cover plate are no longer locked together. Over a period of time, the rail brace may move horizontally with respect to the cover plate and move away from the rail.

Accordingly, it has been found desirable to provide an adjustable rail brace assembly that is retained in position by an elastic fastener in which the rail brace is permitted to move in a vertical plane with respect to the locking member, but is restrained from moving in a horizontal plane with respect to the locking member.

Additionally, it has been found desirable to provide an adjustable rail brace assembly in which a rail brace, having rail engaging surfaces is retained in position by a cover plate biased into contact therewith by an elastic fastener in which the axis of the fastener is parallel to the rail engaging surfaces of the rail brace.

SUMMARY OF THE INVENTION

The instant invention is directed to an adjustable rail brace assembly for buttressing the head of a rail by engaging a fishing surface on the head of the rail and a fishing surface on the base of the rail. The adjustable rail brace assembly comprises a rail brace having an upper surface for engaging the head fishing surface, a lower surface for engaging the base fishing surface, a generally horizontally extending seating surface, and a generally vertically extending wedging face; and a cover plate having a generally horizontally extending seating surface, which overlies the brace seating surface, a generally vertically extending wedging face which engages the brace wedging face to prevent the brace from moving out of engagement with the rail, a top surface and a stop surface. The brace wedging face and the cover plate wedging face include an interlock means for interlocking said brace and said cover plate such that the brace and the cover plate cover move relative to each other in a vertical plane, but are restrained from moving relative to each other in a horizontal plane. The rail brace assembly also comprises a stop member having a stop surface which engages the cover plate stop surface to prevent the cover plate from moving laterally away from the rail and an elastic fastener means which engages the top surface of the cover plate for preventing movement of the cover plate in a vertical direction.

The invention further is directed to an adjustable rail brace assembly for buttressing the head of a rail by engaging a fishing surface on the head of a rail and a fishing surface on the base of the rail. The rail brace assembly comprises a rail brace having an upper surface for engaging the head fishing surface, a lower surface for engaging the base fishing surface, a generally horizontally extending seating surface, and a generally vertically extending wedging face; and a cover plate having a generally horizontally extending seating surface which overlies the brace seating surface, a generally vertically extending wedging face which engages the brace wedging face to prevent the brace from moving out of engagement with the rail, a top surface and a stop surface. A stop member having a stop surface engages the cover plate stop surface to prevent the cover plate from moving laterally away from the rail and an elastic fastener means engaging the top surface of the cover plate for preventing movement of the cover plate in a vertical direction. The elastic fastener means includes a mounting member having a recepticle attached to the stop member and an elastic member having one end which is received in the recepticle and another end which engages the cover plate and exerts a vertically downward directed force thereon and the axis of the recepticle and of said one end are parallel to the brace upper surface and the brace lower surface.

DESCRIPTION OF THE PREFERRED EMBODIMENT

Figure 1:
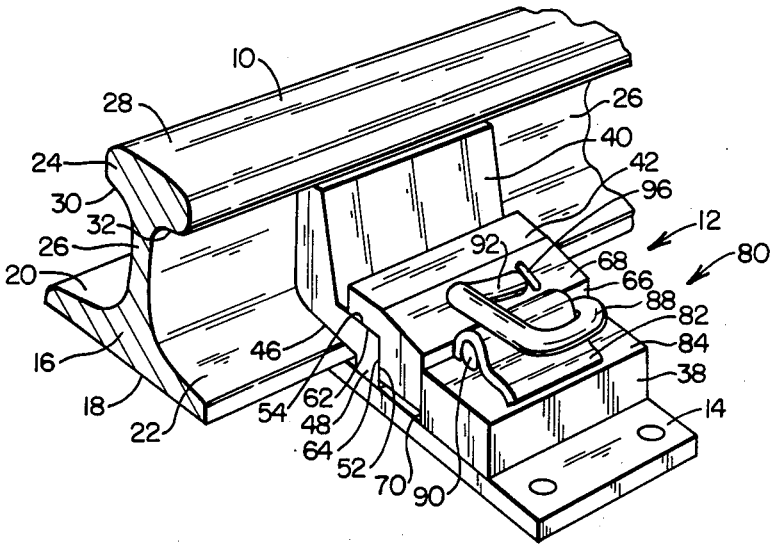
FIG. 1 is a perspective view of the adjustable rail brace assembly of the instant invention.

Referring to FIG. 1, a stock rail 10 and a rail brace assembly 12 are shown seated upon a tie plate 14 that is spiked or bolted to a railroad tie not shown. Rail 10 includes a generally laterally extending base 16 having a bottom surface 18, which rests upon tie plate 14 and a pair of inclined top surfaces 20 and 22 that are commonly referred to as base fishing surfaces. The rail 10 also includes a head 24 which is connected to base 16 by a vertical web 26 and which includes a top surface 28, that engages the treads of railroad car and locomotive wheels and a pair of angled underside surfaces 30 and 32 that are commonly referred to as head fishing surfaces.

As mentioned previously, a function of the rail brace assembly 12 of the present invention is to prevent the head 24 of rail 10 from rolling or becoming angularly displaced with respect to the vertical axis of the rail 10 when rail traffic passes over the rail. The rail brace assembly also functions to clamp the base 16 of rail 10 against a shoulder 34 formed on tie plate 14 as may be seen by referring to FIG. 2, to maintain the gauge of the track. To accomplish this, the rail brace assembly 12 is interposed between the side of the rail 10 opposite that which engages the flanges of the railroad car wheels and a wedge block 38 which is rigidly affixed to the top surface of tie plate 14 by any convenient method such as welding. Rail brace assembly 12 includes a brace 40 which engages the base and head fishing surfaces 22 and 32 respectively, on rail 10 and a cover plate 42 which functions to wedge brace 40 against rail 10 and to prevent vertical movement of brace 40 as will be discussed in detail hereinafter. Brace 40 includes slanted upper and lower surfaces 44 and 46 on the side of brace 40 facing rail 10. The surfaces 44 and 46 engage the rail fishing surfaces 20 and 22, respectively, when the brace 40 is positioned against rail 10. The lower portion of brace 40 includes a downwardly extending leg 48 having a generally flat bottom surface 50, which engages the top of tie plate 14. A vertically extending wedging face 52 is formed along the outside surface of leg 48. The wedging face 52 is tapered in the longitudinal direction as may be seen best by referring to FIG. 3. A plurality of vertically aligned corrugations or serrations are formed on wedging face 52. A generally horizontally extending seating surface 54 on brace 40 defines the top side of leg 48.

The cover plate 42 has a generally L-shaped body. A generally horizontally extending seating surface 62 is formed along the inner surface of one leg of cover plate 42 and a generally vertically extending wedging face 64 is formed along the inner surface of the other leg. A plurality of vertically extending corrugations or serrations complimentary with those formed on wedging face 52 of brace 40 are formed along wedging face 64. Additionally, wedging face 64 has a longitudinally extending taper which compliments the taper formed along wedging face 52 of brace 40. Cover plate 42 also includes a generally vertical stop surface 66 and a slanted top surface 68, which intersects the stop surface 66.

Figure 2:
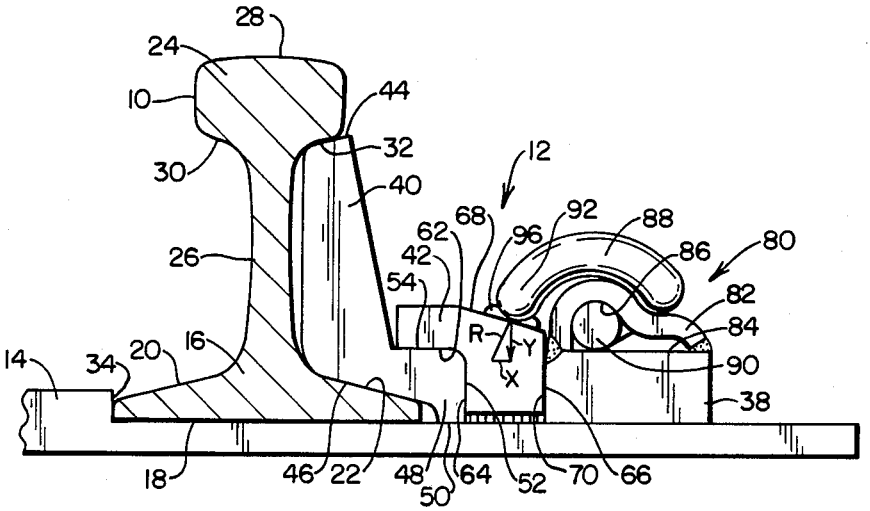
FIG. 2 is a side view of the instant rail brace assembly taken through a lateral section of a stock rail.
Figure 3:
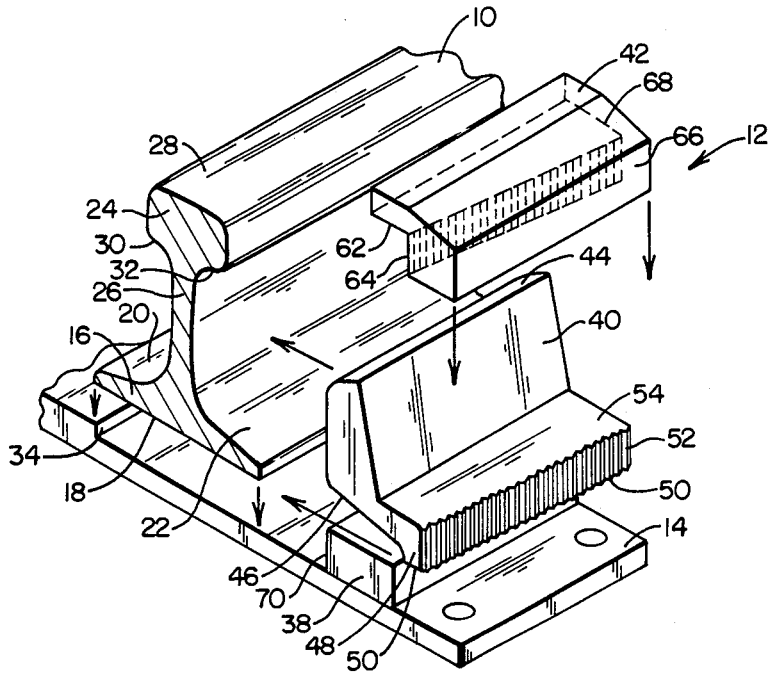
FIG. 3 is an exploded view of the rail brace assembly without an elastic fastener.

Referring to FIG. 2, it may be observed that when cover plate 42 is assembled with brace 40, vertically extending wedging face 64 of cover plate 42 engages the complimentary wedging face 52 on brace 40, horizontally extending seating surface 62 overlies and engages brace seating surface 54 and stop surface 66 on cover plate 42 engages a vertical stop surface 70 on wedge block 38 to prevent lateral movement of rail brace assembly 12. To assemble rail brace assembly 12, cover plate 42 is moved longitudinally with respect to brace 40 and thereafter moved downwardly such that cover plate wedging face 64 engages brace wedging face 52 to achieve the desired fit or tolerance between stop surface 66 on cover plate 62 and stop surface 70 on wedge block 38. If a tighter fit between these two elements is required, cover plate 42 is moved in one direction to achieve a greater wedging action between the wedging faces 52 and 64. If a looser fit or greater tolerance between the stop surfaces 66 and 70 is desired, cover plate 42 is moved in the opposite direction to reduce the wedging action caused by the tapered wedging faces 52 and 64. Generally, a tight fit is desired between the stop surfaces 66 and 70 and such a fit ensures that the slanted lower surface 46 and the slanted upper surface 44, formed on a rail brace 40 will tightly engage the fishing surfaces 22 and 32 on rail 10. In this position rail brace 40 simultaneously prevents the head 24 of rail 10 from rolling and maintains the gauge of the track by keeping the base 16 of the rail 10 tight against the shoulder 34 formed in tie plate 14. Thus, it may be seen that the wedging action of cover plate 42 between rail brace 40 and wedge block 38 prevents lateral or horizontal movement of the brace 40 away from rail 10. Additionally, because the mating surfaces between the brace 40 and cover plate 42, i.e., seating surfaces 54 and 62 and wedging faces 52 and 64 are at right angles to each other, the brace 40 is prevented from rotating about its centroid away from contact with the rail brace 40. The engagement of leg 48 with tie plate 14 also helps to maintain brace 40 against the rail fishing surfaces 22 and 32.

A fastener assembly 80 applies a constant vertically downwardly directed force to the slanted top surface 68 to cover plate 42 to bias cover plate seating surface 62 against rail brace seating surface 54 to thereby prevent vertical separation of these elements. Fastener assembly 80 includes a recepticle or shoulder 82 that is welded onto the top surface 84 of wedge block 38. A hole 86 extends longitudinally through recepticle 82, parallel to the longitudinal axis of rail 10. A unitary elastic fastener 88 having a straight leg 90 at one end thereof, which is received within hole 86 and another straight leg 92 at the other end thereof, which engages the slanted top surface 68 of cover plate 42, applies a constant downwardly directed force thereon. It may be observed that top surface 68 is slanted in such a way that the resultant force R applied by fastener 88 may be resolved into a vertically downwardly directed component Y and a horizontal component X which acts in the direction of rail brace 40 to bias the brace 40 against the fishing surfaces 22 and 32. Because the axis of hole 86 is parallel to the longitundal axis of rail 10, automatic machines may be utilized to insert the elastic fastener 88 into the hole 86.

It has been found that as rail traffic passes over the rail 10, the rail will automatically be pushed downwardly against the tie plate 14 and the tie not shown, such that a momentary separation may occur between the seating surfaces 54 and 62 formed on the brace 40 and the cover plate 42, respectively. This occurs despite the force applied by the elastic fastener 88. However, because the wedging faces 52 and 64 are aligned vertically and the corrugations or surrations thereon extend in a vertical direction, there is no longitudinal slippage or tendancy of the cover plate 42 to move away from the rail brace 40. Consequently, the design of the present invention wherein the interlocking means on the wedging faces 52 and 64 are vertically aligned acts to prevent loosening of the rail brace assembly 12.

Turning to FIG. 1, it may be observed that a rib 96 is formed on the slanted top surface 68 of cover plate 42. Rib 96 acts to prevent elastic fastener 88 from backing out of recepticle 82 due to vibration. Rib 96 is shallow enough to permit the fastener 88 to be driven out of recepticle 82 in a conventional manner Alternatively, such as by use of a hammer, groove may be formed in the top surface 68 at the end of leg 92 in place of rib 96 to prevent unintended movement of fastener 88.

Since certain changes may be made in the above-described system and apparatus without departing from the scope of the invention herein involved, it is intended that all matter contained in the description or shown in the accompanied drawings shall be interpreted as illustrative and not in a limiting sense.

We claim:

1. An adjustable rail brace assembly for buttressing the head of a rail by engaging a fishing surface on the head of the rail and a fishing surface on the base of the rail which comprises:

a rail brace having an upper surface for engaging the head fishing surface, a lower surface for engaging the base fishing surface, a generally horizontally extending seating surface, and a generally vertically extending wedging face;

a cover plate having a generally horizontally extending seating surface which overlies said brace seating surface, a generally vertically extending wedging face which engages said brace wedging face to prevent said brace from moving out of engagement with said rail and a top surface;

said brace wedging face and said cover plate wedging face including interlock means for interlocking said brace and said cover plate such that said brace and said cover plate can move relative to each other in a vertical plane but are restrained from moving relative to each other in a horizontal plane;

a stop surface formed on said cover plate for engaging a stop surface formed on a stop member to prevent said cover plate from moving laterally away from said rail; and elastic fastener means which engages the top surface of said cover plate for preventing movement of said cover plate in a vertical direction.

2. The adjustable rail brace assembly of claim 1 in which:

said brace wedging face and said cover plate wedging face extend non-parallel to said brace upper surface and said brace lower surface and said brace wedging face and said cover plate wedging face lie in a vertical plane.

3. The adjustable rail brace assembly of claim 2 in which:

said elastic fastener means includes a mounting member having a recepticle attached to said stop member and an elastic member having one end which is received in said recepticle and another end which engages the top surface of said cover plate and exerts a vertically downwardly directed force thereon; and wherein the axes of said recepticle and of said one end are parallel to said brace upper surface and said brace lower surface.

4. The adjustable rail brace assembly of claim 3 in which:

means for retaining said elastic member within said recepticle are formed on said top surface of said cover plate.

5. The adjustable rail brace assembly of claim 4 in which:

said retaining means includes a rib formed on said top surface.

6. The adjustable rail brace assembly of claim 4 in which:

said retaining means includes a groove formed in said top surface.

7. The adjustable rail brace assembly of claim 3 in which:

said top surface of said cover plate is slanted; and wherein component of said vertically downwardly directed force is directed towards said rail such that said rail brace is biased toward said rail 8. The adjustable rail brace assembly of claim 1 in which:

said interlock means includes a first set of serrations formed on said rail brace wedging face and a second set of serrations formed on said cover plate wedging face;

said first and second sets of serrations are arranged such that lateral movement between said rail brace and said cover plate is prevented when said rail brace wedging face engages said cover plate wedging face.

9. An adjustable rail brace assembly for buttressing the head of a rail by engaging a fishing surface on the head of the rail and a fishing surface on the base of the rail which comprises:

a rail brace having an upper surface for engaging the head fishing surface, a lower surface for engaging the base fishing surface, a generally horizontally extending seating surface, and a generally vertically extending wedging face;

a cover plate having a generally horizontally extending seating surface which overlies said brace seating surface, a generally vertically extending wedging face which engages said brace wedging face to prevent said brace from moving out of engagement with said rail, and a top surface;

a stop surface formed on said cover plate for engaging a stop surface formed on a stop member to prevent said cover plate from moving laterally away from said rail;

elastic fastener means which engages the top surface of said cover plate for preventing movement of said cover plate in a vertical direction;

said elastic fastener means includes a mounting member having a recepticle attached to said stop member and an elastic member having one end which is received in said recepticle and another end which engages said cover plate and exerts a vertically downwardly directed force thereon; and wherein the axes of said recepticle and of said one end are parallel to said brace upper surface and said brace lower surface.

10. An adjustable rail brace assembly for buttressing the head of a rail by engaging a fishing surface on the head of the rail and a fishing surface on the base of the rail which comprises:

a rail brace having an upper surface for engaging the head fishing surface, a lower surface for engaging the base fishing surface, a generally horizontally extending seating surface, and a generally vertically extending wedging face;

a cover plate having a generally horizontally extending seating surface which overlies said brace seating surface, a generally vertically extending wedging face which engages said brace wedging face to prevent said brace from moving out of engagement with said rail and a top surface;

said brace wedging face and said cover plate wedging face including interlock means for interlocking said brace and said cover plate such that said brace and said cover plate can move relative to each other in a vertical plane but are restrained from moving relative to each other in a horizontal plane;

a stop surface formed on said cover plate for engaging a stop surface formed on a stop member to prevent said cover plate from moving laterally away from said rail;

elastic fastener means which engages the top surface of said cover plate for preventing movement of said cover plate in a vertical direction;

said rail is seated on a tie plate and is rigidly affixed thereto;

said stop member is adapted to be seated on said tie plate and rigidly affixed thereto;

said rail brace includes a vertically downwardly extending leg which is adapted to contact said tie plate; and said rail brace seating surface engages said cover plate seating surface and simultaneously said rail brace wedging face engages said cover plate wedging face to thereby prevent said rail brace from rotating away from said rail.

11. The adjustable rail brace assembly of claim 10 in which:

said brace wedging face and said cover plate wedging face extend non-parallel to said brace upper surface and said brace lower surface and said brace wedging face and said cover plate wedging face lie in a vertical plane.

12. The adjustable rail brace assembly of claim 11 in which:

said elastic fastener means includes a mounting ember having a recepticle attached to said stop member and an elastic member having one end which is received in said recepticle and another end which engages the top surface of said cover plate and exerts a vertically downwardly directed force thereon; and wherein the axes of said recepticle and of said one end are parallel to said brace upper surface and said brace lower surface.

13. The adjustable rail brace assembly of claim 12 in which:

means for retaining said elastic member within said recepticle are formed on said top surface of said cover plate.

14. The adjustable rail brace assembly of claim 13 in which:

said retaining means includes a rib formed on said top surface.

15. The adjustable rail brace assembly of claim 13 in which:

said retaining means includes a groove formed in said top surface.

16. The adjustable rail brace assembly of claim 12 in which:

said top surface of said cover plate is slanted; and wherein component of said vertically downwardly directed force is directed towards said rail such that said rail brace is biased toward said rail.

17. The adjustable rail brace assembly of claim 10 in which:

said interlock means includes a first set of serrations formed on said rail brace wedging face and a second set of serrations formed on said cover plate wedging face;

said first and second sets of serrations are arranged such that lateral movement between said rail brace and said cover plate is prevented when said rail brace wedging face engages said cover plate wedging face.

* * * * *